United States Patent [19]

Swin, Sr. et al.

[11] 4,323,330

[45] Apr. 6, 1982

[54] VANELESS DIFFUSER

[75] Inventors: Richard E. Swin, Sr., Burr Ridge; Anwar A. Atalla, Willowbrook, both of Ill.

[73] Assignee: Tec-Air, Inc., Willow Springs, Ill.

[21] Appl. No.: 57,559

[22] Filed: Jul. 16, 1979

[51] Int. Cl.[3] ..... F04D 29/44

[52] U.S. Cl. ..... 415/207

[58] Field of Search ..... 415/146, 147, 207, 219 A, 415/213 B, 213 R; 416/192

[56] References Cited

U.S. PATENT DOCUMENTS 2,660,366 11/1953 Klein et al. ..... 415/219 A 3,771,925 11/1973 Friberg et al. ..... 415/219 A

*Primary Examiner*—Leonard E. Smith

*Attorney, Agent, or Firm*—August E. Roehrig, Jr.

[57] ABSTRACT

A mixed flow fan assembly including a rotating mounted impeller having a plurality of blades. An orifice member is mounted adjacent the tip of the blades to form an orifice area to receive air drawn in by an impeller in a first direction. A vaneless diffuser is created by an outlet diffuser element and a spaced plate to receive air drawn by the impeller and discharge air expandably and outwardly in a direction perpendicular thereto. The plate, outlet diffuser element and orifice member in various embodiments are selectively attached to the blade to rotate therewith or be stationary in relation thereto.

8 Claims, 13 Drawing Figures

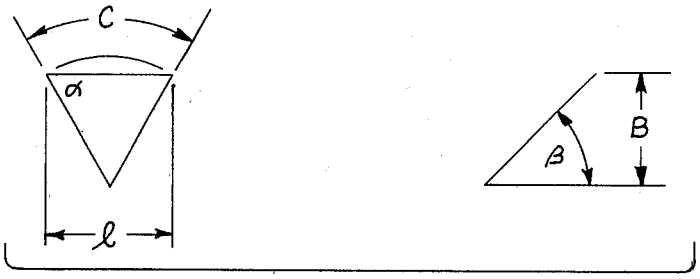
DIAGRAM A
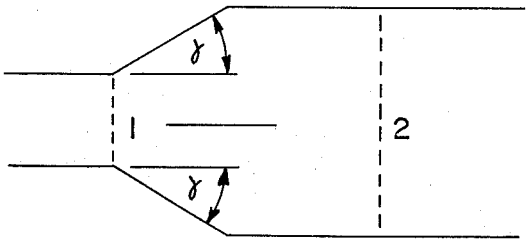
$VP_1 + SP_1 = VP_2 + SP_2$
DIAGRAM b
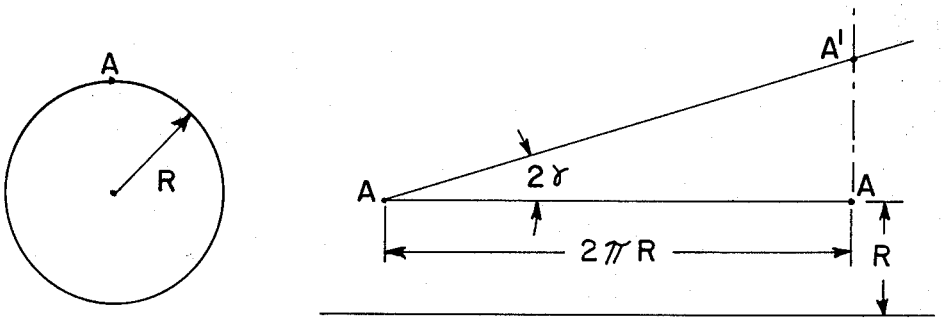
DIAGRAM c

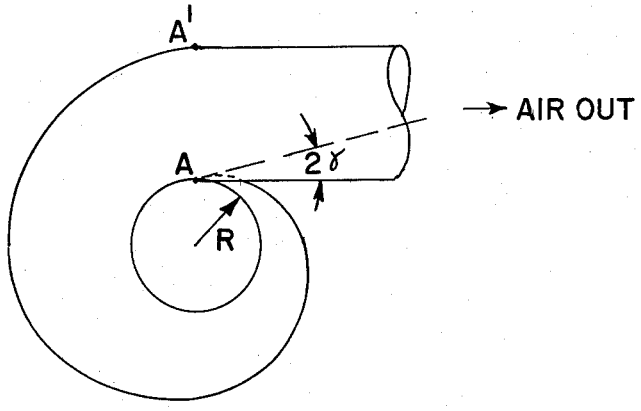
DIAGRAM d
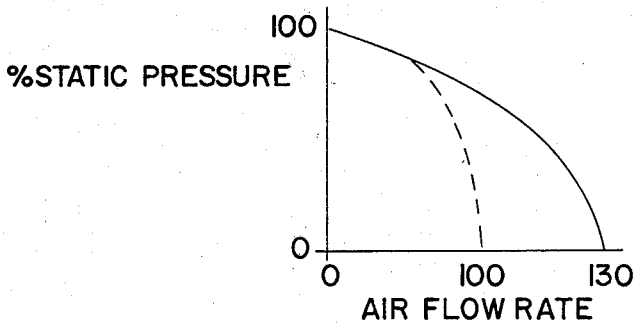
DIAGRAM e

VANELESS DIFFUSER

BACKGROUND OF THE INVENTION

This invention relates in general to circulating fans and in particular to mixed flow fans of the axial fan configuration. More specifically, but without restriction to the particular use which is shown and described, this invention relates to mixed flow fans of the axial fan configuration having rotating vaneless diffusers attached thereto.

Circulating fans are found in many diverse applications ranging from the common household cooling fan to the more sophisticated jet engine compressor fan. Other applications include fans designed for use in refrigerator and freezer compartments, cooling fans for lighting fixtures, and circulating fans for use in recreational rooms, bathrooms, closets and the like. Although the invention disclosed herein has general application as a mixed flow fan, for convenience of illustration, the preferred embodiment will be described with reference to a mixed flow fan and rotating vaneless diffuser incorporated in a ceiling mounted, illuminated ventilating unit. An example of such a vaneless diffuser is disclosed in my copending application, Ser. No. 57,592 for Ductless Air Treating Device with Illuminator filed concurrently herewith.

Fans may be classified generally as one of four types, axial, centrifugal, transverse, or mixed. An axial fan takes air in axially from a direction parallel to the axis of the fan rotation, and also discharges the air in the axial direction. A centrifugal fan also takes in air axially, but discharges the air radially in a direction perpendicular to its axis of rotation. A mixed flow fan takes in air axially and discharges the air in a direction lying between the axial and radial directions. Other considerations involved in the design and construction of air circulating or ventilating devices include the configurations of the blades and the housing enclosure.

The blade is constructed in accordance with the following range of applicable dimensions, which are illustrated graphically in diagram A. The dimension c is the blade arc length measured between the leading and trailing edges of the blade. R is the radius of curvature of the blade, l is the cord length between the leading and trailing edges of the blade, and the angle is the angle between the cord and radius R of the blade. The distance f is known as the camber, and the angle is the pitch angle of the blade. The total axial depth of the blade is shown by the letter B. The angles $\alpha$ and $\beta$ generally range between 40° and 60°, and the camber to cord ratio varies between 0.10 and 0.25. The dimensions B, c and R, are established from the relationships:

TABLE I $$B = 1 \sin \beta$$

$$R = \frac{1}{2 \cos \alpha}$$

$$c = \frac{180 - 2\alpha}{360\alpha} \times 2\pi R$$

The desired B dimension is selected to suit the application and is generally in the order of from 15% to 40% of the impeller diameter (2R).

For example, suitable dimensions of a fan designed for refrigerator and freezer evaporator applications would include a $4\frac{1}{2}$ inch diameter impeller having an axial blade depth of 0.75 inch. By fixing both the angles $\alpha$ and $\beta$ at 45°, the impeller will have a discharge angle from the trailing edge of each blade parallel to the axis of fan rotation. The significant dimensions therefore are as follows:

$\alpha = B = 45°$ $B = 0.75$ in.

$l = 1.0607$ in.

$R = 0.75$ in.

A suitable hub diameter for the fan would be 1.25 inches, which would give a hub to tip ratio of 0.2778.

Section of a suitable diffusion housing is essential to the proper operation of a circulating fan. The basic concept behind the operation of a diffuser is the conversion of energy. Referring to diagram b, a simple diffuser is illustrated with the air flowing from left to right in the direction of the arrow. The air in this system may be described mathematically in an energy conservation equation which relates to the velocity pressure of the air, which is analogous to its kinetic energy, and the static pressure of the air, which is analogous to its potential energy. Assuming no energy losses, the total energy level of the air in the system must be constant at both points, and it is evident from the equation that the function of a fan is to convert the velocity pressure into static pressure. The sum of the velocity pressure and the static pressure at point 1 must equal the sum of the velocity pressure and static pressure at point 2.

The configuration for the vane diffuser or scroll for a fan having an impeller radius of R is determined by drawing a line equal in length to the circumference of the impeller $2\pi R$ as shown in diagram c. By projecting a line from point A in the diagram outwardly at the selected diffusion angle $2\gamma$ and rolling the line back up in a circle as is shown in diagram d the general shape of the housing is determined.

For maximum efficiency and diffusion rate, a 14° angle of diffusion ($2\gamma$) for the housing or scroll is preferred. However, from practical considerations, housings having this diffusion angle are generally too large. Therefore, as a tradeoff, smaller diffusion angles, for example 5° to 8°, are generally used.

Within a given housing a fan is capable of developing different levels of static pressure depending upon the blockage to air flow. Maximum pressure occurs when complete blockage of the discharge is effected. Maximum flow or free flow occurs when no restriction to the discharge is imposed. The different points or levels of energy between complete blockage and free flow comprise what is known as the air performance capability of a fan. The performance curve for a mixed flow fan contained within a 6.5 diffusion housing is shown by the dotted line in diagram e.

The solid line in diagram e depicts the operating characteristics of the same mixed flow fan operating in a static vaneless diffuser without the 6.5 diffusion housing. A significant gain in performance, an increase of approximately 30% in the free flow air delivery rate, is realized. This gain may be translated into a speed reduction of 30% which, in turn, results in substantially lower noise levels. A further reduction of the rotational noise level may be obtained by attaching the vaneless diffuser to the fan itself. An impeller having a rotating vaneless diffuser as an integral part thereof reduces the clearance between the blade tip and the diffuser effectively to zero which eliminates much of the air entry shock losses and improves the volumetric and mechanical efficiency of the device.

SUMMARY OF THE INVENTION

It is therefore, an object of this invention to improve circulating fans.

Another object of this invention is to improve mixed flow fans of the axial fan configuration.

A further object of this invention is to improve circulating fans which are used in conjunction with vaneless diffusers.

Yet another object of this invention is to improve mixed flow fans of the axial fan configuration which are used in conjunction with vaneless diffusers.

These and other objects are attained in accordance with the present invention wherein there is provided a mixed flow fan of the axial fan configuration having a rotating vaneless diffuser attached thereto.

DESCRIPTION OF THE DRAWINGS

Further objects of this invention, together with additional features contributing thereto and advantages accruing therefrom will be apparent from the following description of the embodiment of the invention when read in conjunction with the accompanying drawings, wherein.

Diagram A is a graphic illustration of the range of applicable dimensions in accordance with which a mixed flow fan blade is constructed;

Diagram b illustrates a simple defuser with the air flowing from left to right in the direction of the arrow;

Diagram c illustrates the configuration for a vane diffuser or scroll for a fan having an impeller radius of R as determined by drawing a line equal in length to the circumference of the impeller;

Diagram d illustrates the matter in which the general shape of a housing is determined; and Diagram e illustrates the performance curve for a mixed flow fan contained within a 6.5 diffusion housing.

DESCRIPTION OF THE PREFERRED EMBODIMENT

Figure 1:
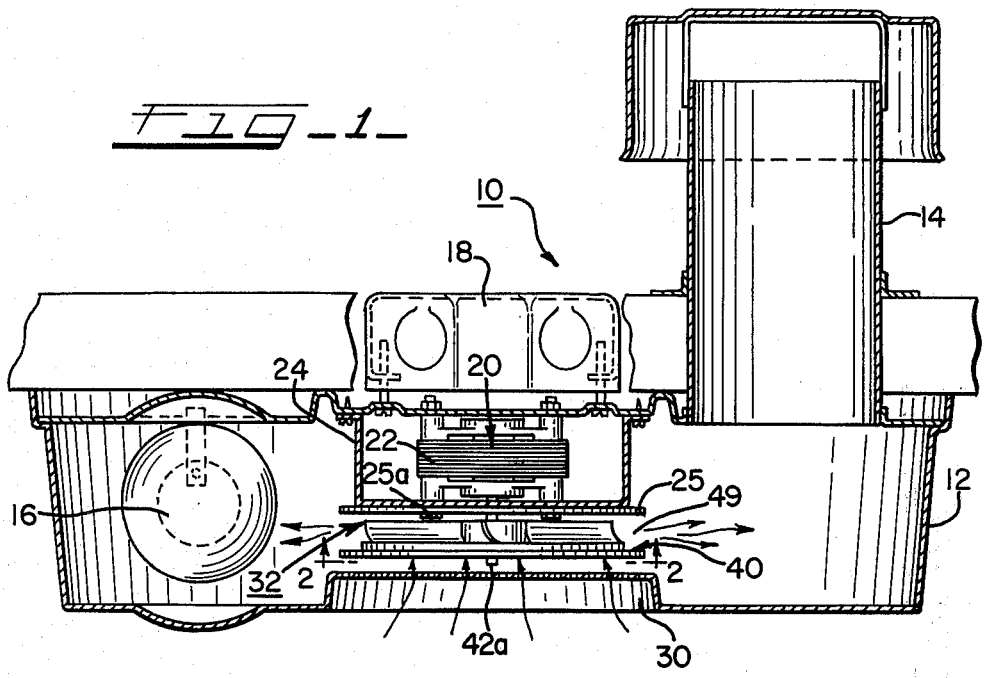
FIG. 1 is a vertical profile view of a ceiling mounted illuminated air circulating device with portions removed to better illustrate the present invention.

Referring now to FIG. 1 there is shown a ceiling mounted ventilating unit shown generally by the numeral 10 having a housing 12, a venting duct 14, and a lighting element 16. The ventilating unit is of the type which may be mounted either directly or indirectly to a junction box shown by the numeral 18. The ventilating unit includes a fan assembly 20 mounted to the ventilator housing 12 having a drive motor 22 contained in a motor housing 24, and a vaneless diffuser shown generally by the numeral 32.

Figure 2:
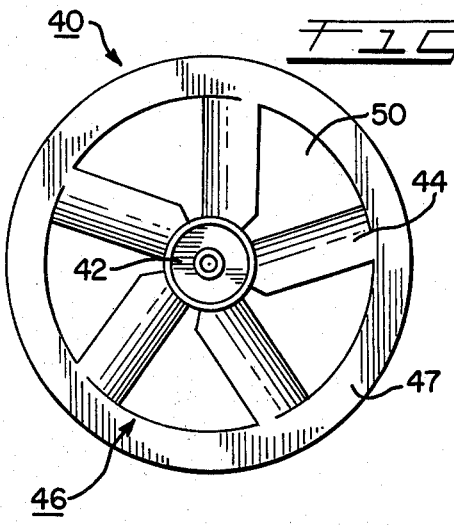
FIG. 2 is a horizontal profile view of the impeller and the rotating portion of the vaneless diffuser taken in the direction of arrows 2—2 in FIG. 1.
Figure 3:
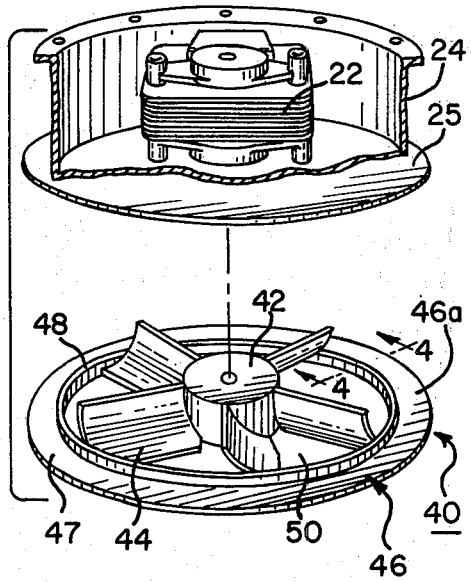
FIG. 3 is an exploded perspective view of the impeller and the vaneless diffuser depicted in FIG. 1.
Figure 4:
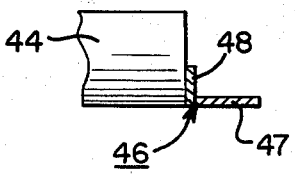
FIG. 4 is a sectional view of the rotating portion of the vaneless diffuser taken in the direction of arrows 4—4 depicted in FIG. 3.
Figure 8:
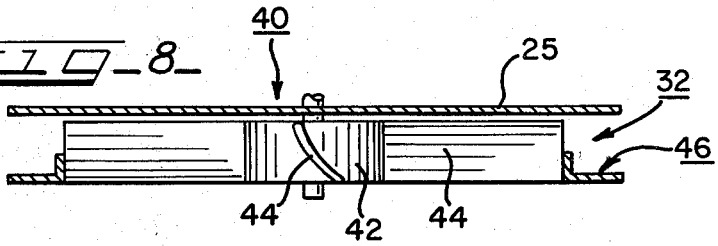
FIG. 8 is a vertical sectional view of the embodiment of the impeller and vaneless diffuser of the present invention illustrated in FIG. 1.

As illustrated in greater detail in FIGS. 2, 3, and 8, fan assembly 20 comprises an upper plate 25 which is stationarily mounted on the bottom portion of the motor housing 24, by bolts **25*a* as shown in FIG. 1. An impeller is depicted generally by the numeral 40 comprising a hub 42 mounted on a motor shaft 42*a*, a plurality of air flow generating blades 44 extending from hub 42 and a rotating diffuser ring coupled to the tips of blades 44 and shown generally as numeral 46. The rotating diffuser ring has an active or outlet portion 47 having a planar annular surface 46*a*. An orifice portion 48 in form of a ring is attached to portion 47 in surrounding relation to blades 44 and defines an orifice areas 50 adjacent impeller 40**.

Rotating diffuser ring 46 cooperates with spaced plate 25 in forming vaneless diffuser 32 and forming a circumferentially diffuser outlet 48 therebetween. Rotation of blades 44 through rotation induced by the motor in housing 24 draw air through orifice area 50 along the axis of rotation against plate 25 whereby air is discharged from the diffuser ring 48 expandably outward in a direction substantially perpendicular to the axis of rotation of the impeller.

Figure 5:
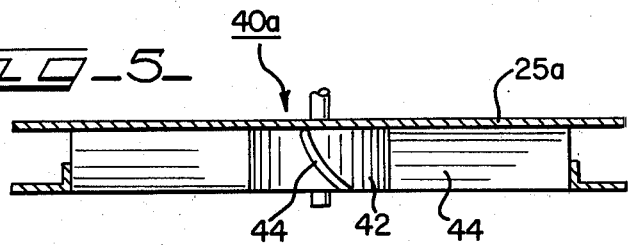
FIG. 5 is a vertical sectional view of one embodiment of the impeller and vaneless diffuser of the present invention.

Referring now to FIG. 5 there is shown another embodiment of an impeller of the present invention depicted by reference numeral **40*a* for use in fan assembly 20 wherein upper plate 25 and the diffuser ring 46 are secured directly to the blades 44 by any appropriate technique, such as, for example by molding, welding or with adhesives. A single rotating structure is thus created which comprises impeller 40, formed by hub 42, and blades 44, and vaneless diffuser 32 including upper plate 25 and diffuser ring 46. The embodiment of the invention described in conjunction with FIG. 5** achieves minimum energy losses and maximum reduction in rotational noise levels because the clearance between the blade tip and diffuser is effectively reduced to zero.

Figure 6:
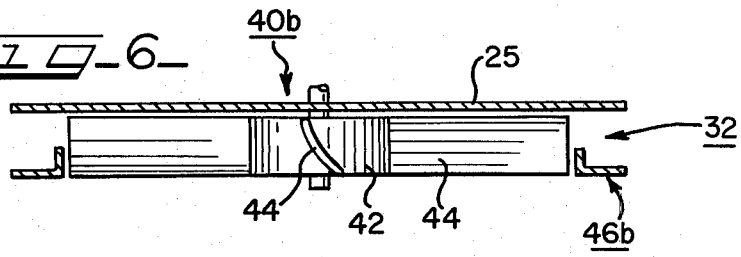
FIG. 6 is a vertical sectional view of another alternate embodiment of the impeller and vaneless diffuser of the present invention.
Figure 7:
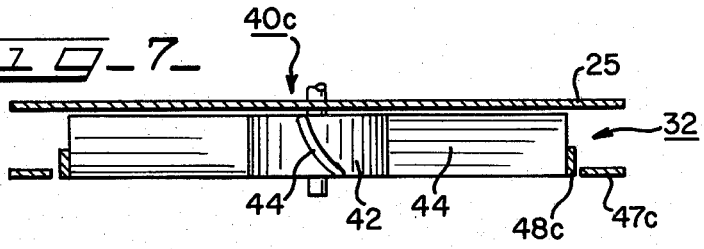
FIG. 7 is a vertical sectional view of still another embodiment of the impeller and vaneless diffuser of the present invention.

The alternate embodiments illustrated in FIGS. 6-8 utilize different combinations of separable stationary and rotating elements for purposes of economy of manufacture and are capable of the approximate improved operation as achieved by the previously described embodiment of FIG. 5. In the embodiment of the impeller **40*b* shown in FIG. 6, upper plate 25 and diffuser ring 46*b* along with the orifice portion which may be simple stampings, are the stationary elements in fan assembly 20 secured against movement by any selected technique. A hub 42 and blades 44, which may be cast as a single unit, for example, form the rotating element. Upper plate 25*a* may be secured against movement in any selected manner such as being attached to motor housing as shown in FIG. 1. Likewise, a suitable means may be employed to prevent movement of ring 46*b* such as it being affixed to housing 12 (not shown) or being coupled to shaft 42 by bearings and the like. Thus, blades 44 are capable of rotational movement relative to plate 25 and ring 46*b*** in this embodiment.

FIG. 7 illustrates a variation of the embodiment shown in FIG. 6 in which impeller **40*c* includes a diffusion ring 46*c* and orifice portion 48*c* is divided into two portions comprising a vertically extending orifice portion 48 which is secured to the blades 44 and a separated horizontally extending outlet portion 47***c* mounted against movement as desired. Upper plate 25 and outlet portion 47*c* form stationary elements and the hub 42, the blades 44, and the orifice portion 48*c* form the rotating elements relative thereto. The impeller 40*b* of this embodiment exhibits maximum strength due to the reinforcement which the orifice portion imparts to the blades.

FIG. 8 illustrates the embodiment of the impeller of the present invention designated by reference numeral 40 previously described in connection with FIGS. 1, 2, and 3 in which the diffuser ring 46 is secured to the blades 44*c* in any appropriate fashion, such as, for example, by a molding process, thereby forming a single rotating structure comprising hub 42, blades 44, and diffusion ring 46. The upper plate 25 forms the stationary element. The possible points of operational contact and, therefore, noise level and energy losses are minimized in this embodiment and the blade reinforcing feature provided by diffusion ring 46 is present.

Referring again to FIG. 1, as indicated by the air flow lines, the rotation of impeller 40 draws air upwardly through inlet 30 in the ventilator housing 12 and through orifice area 50 formed in the impeller 40 by the orifice ring 48. Pressure created by the rotation of the impeller imparted to the air by the blades 44 forces air contained therein outwardly into the diffuser outlet portion 32 and then further outwardly into the interior of the ventilator housing 12 where it serves to cool duct 14. Any of the foregoing embodiments of the impeller may be utilized in combination.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An impeller and vaneless diffuser for a mixed flow fan assembly comprising support means for supporting a plurality of air flow generating blades outwardly therefrom for rotational movement about an axis, rotation means coupled to the support means for inducing rotational movement of said plurality of air flow generating blades to draw air therepast in a first direction, vaneless diffuser means includes a first member operatively coupled to said plurality of air flow generating blades at a free end thereof and extending outwardly therefrom parallel to the axis of rotation of said blades to receive air drawn by said blades, and said diffuser means further including a second member mounted perpendicular to said first member and extending radially outwardly therefrom to form an outlet to discharge air drawn by said air flow generating blades in a second direction.

2. The impeller and vaneless diffuser of claim 1 wherein said support means, said air flow generating blades, and said first and second members of said vaneless diffuser means are interconnected to rotate as an unitary body about said axis.

3. The impeller and vaneless diffuser of claim 1 wherein said second member of said vaneless diffuser means is mounted in a stationary position permitting rotational movement of the air flow generating blades and the first member of said vaneless diffuser means relative thereto.

4. The impeller and vaneless diffuser of claim 1 further comprising an orifice forming means to form an orifice area adjacent to said air flow generating blades.

5. The impeller and vaneless diffuser of claim 4 wherein said orifice forming means is attached to said air flow generating blades to rotate therewith.

6. The impeller and vaneless diffuser of claim 1 wherein said first member is circumferentially disposed about said axis.

7. The impeller and vaneless diffuser of claim 6 wherein said second member includes a circumferential surface lying in a plane substantially perpendicular to said axis.

8. The impeller and vaneless diffuser of claim 7 wherein said second direction is substantially perpendicular to said first direction.

* * * * *